US009284857B2

(12) United States Patent
Ho et al.

(10) Patent No.: US 9,284,857 B2
(45) Date of Patent: Mar. 15, 2016

(54) ORGANIC FLASH CYCLES FOR EFFICIENT POWER PRODUCTION

(71) Applicant: The Regents of the University of California, Oakland, CA (US)

(72) Inventors: Tony Ho, Southington, CT (US); Samuel S. Mao, Castro Valley, CA (US); Ralph Greif, Berkeley, CA (US)

( * ) Notice: Subject to any disclaimer, the term of this patent is extended or adjusted under 35 U.S.C. 154(b) by 21 days.

(21) Appl. No.: 13/923,159

(22) Filed: Jun. 20, 2013

(65) Prior Publication Data

US 2013/0341929 A1 Dec. 26, 2013

Related U.S. Application Data

(60) Provisional application No. 61/664,697, filed on Jun. 26, 2012.

(51) Int. Cl.

| | |
|---|---|
| ***F01K 25/08*** | (2006.01) |
| ***F01K 25/10*** | (2006.01) |
| ***F01K 13/02*** | (2006.01) |
| ***F01K 25/04*** | (2006.01) |
| ***F01K 25/00*** | (2006.01) |
| ***F22B 3/04*** | (2006.01) |
| ***F01K 23/10*** | (2006.01) |
| ***F01K 13/00*** | (2006.01) |

(Continued)

(52) U.S. Cl.

CPC ..... *F01K 25/08* (2013.01); *F01K 13/00* (2013.01); *F01K 13/02* (2013.01); *F01K 23/10* (2013.01); *F01K 25/00* (2013.01); *F01K 25/04* (2013.01); *F01K 25/10* (2013.01); *F01K 25/14* (2013.01); *F22B 3/04* (2013.01); *F22B 27/00* (2013.01)

(58) Field of Classification Search

CPC ..... F01K 23/10; F01K 25/10; F01K 25/08; F01K 25/04; F01K 25/00; F01K 25/14; F01K 13/00; F01K 13/02; F22B 3/04; F22B 27/00

USPC ..... 60/651, 671

See application file for complete search history.

(56) References Cited

U.S. PATENT DOCUMENTS 3,636,706 A * 1/1972 Minto ..... 60/651
4,191,021 A * 3/1980 Nakamura et al. ..... 60/657

(Continued)

OTHER PUBLICATIONS

T. Ho et. al., "Increased power production through enhancements to the Organic Flash Cycle (OFC)," Energy, 2012, 42, pp. 686-695.

(Continued)

*Primary Examiner* — Audrey K Bradley
*Assistant Examiner* — Wesley Harris
(74) *Attorney, Agent, or Firm* — Lawrence Berkeley National Laboratory

(57) ABSTRACT

This disclosure provides systems, methods, and apparatus related to an Organic Flash Cycle (OFC). In one aspect, a modified OFC system includes a pump, a heat exchanger, a flash evaporator, a high pressure turbine, a throttling valve, a mixer, a low pressure turbine, and a condenser. The heat exchanger is coupled to an outlet of the pump. The flash evaporator is coupled to an outlet of the heat exchanger. The high pressure turbine is coupled to a vapor outlet of the flash evaporator. The throttling valve is coupled to a liquid outlet of the flash evaporator. The mixer is coupled to an outlet of the throttling valve and to an outlet of the high pressure turbine. The low pressure turbine is coupled to an outlet of the mixer. The condenser is coupled to an outlet of the low pressure turbine and to an inlet of the pump.

20 Claims, 13 Drawing Sheets

(51) Int. Cl.
*F01K 25/14* (2006.01)
*F22B 27/00* (2006.01)

(56) References Cited

U.S. PATENT DOCUMENTS

| | | | | |
|---|---|---|---|---|
| 4,557,112 | A * | 12/1985 | Smith | 60/651 |
| 5,754,613 | A * | 5/1998 | Hashiguchi et al. | 376/378 |
| 2009/0320473 | A1* | 12/2009 | Krieger et al. | 60/641.2 |
| 2010/0300093 | A1* | 12/2010 | Doty | 60/641.2 |
| 2011/0000205 | A1* | 1/2011 | Hauer et al. | 60/511 |
| 2011/0259010 | A1* | 10/2011 | Bronicki et al. | 60/651 |
| 2012/0227404 | A1* | 9/2012 | Schuster et al. | 60/651 |
| 2013/0174552 | A1* | 7/2013 | Mahmoud et al. | 60/671 |

OTHER PUBLICATIONS

T. Ho et. al., "Comparison of the Organic Flash Cycle (OFC) to other advanced vapor cycles for intermediate and high temperature waste heat reclamation and solar thermal energy," Energy, 2012, 42, pp. 213-223.

Legmann H., "Recovery of industrial heat in the cement industry by means of the ORC process," IEEE 44th Cement Industry Technical Conference 2002, Jacksonville, FL, USA, pp. 29-35.

Desai N. B., Bandyopadhyay S., "Process integration of organic Rankine cycle." Energy, 2009, 34, pp. 1674-1686.

Chacartegui R, Sánchez D, Muñoz JM, Sánchez T., "Alternative ORC bottoming cycles for combined cycle power plants," Applied Energy, 2009, 86, pp. 2162-2170.

Tchanche B.F., Lambrinos GR, Frangoudakis A., Papadakis G., "Low-grade heat conversion into power using organic Rankine cycle-A review of various applications," Renewable and Sustainable Energy Reviews 2011, 15, pp. 3963-3979.

Fischer J., "Comparison of trilateral cycles and organic Rankine cycles," Energy 2011, 36, pp. 6208-6219.

Ho T., "Advanced organic vapor cycles for improving thermal conversion efficiency in renewable energy systems," PhD Dissertation—University of California at Berkeley, May 2012, Berkeley, CA, USA.

Smith I.K., "Development of the trilateral flash cycle system part 1: fundamental considerations," Proceedings of the Institution of Mechanical Engineers, Part A: Journal of Power and Energy 1993, 207, pp. 179-194.

Zamfirescu C., Dincer I., "Thermodynamic analysis of a novel ammonia-water trilateral Rankine cycle," Thermochimica Acta, 2008, 477, pp. 7-15.

Dai Y., Wang J., Gao L., "Parametric optimization and comparative study of organic Rankine cycle (ORC) for low grade waste heat recovery," Energy Conversion and Management 2009, 50, pp. 576-582.

Galanis N., Cayer E., Roy P., Denis E.S., Désilets M., "Electricity generation from low temperature sources," Journal of Applied Fluid Mechanics 2009, 2, pp. 55-67.

Quoilin S., Declaye S., Lemort V., "Expansion machine and fluid selection for the organic Rankine cycle," 7th international conference on heat transfer, fluid mechanics and thermodynamics, Antalya, Turkey, Jul. 19, 2010.

Macchi E., Perdichizzi A., "Efficiency prediction for axial-flow turbines operating with nonconventional fluids," ASME Journal of Engineering for Power, 1981, 103, pp. 718-724.

Chen H., Goswami D.Y., Stefanakos E.K., "A review of thermodynamic cycles and working fluids for the conversion of low-grade heat," Renewable and Sustainable Energy Reviews 2010, 14, pp. 3059-3067.

Ho T., et al., "Improved intermediate waste heat reclamation with the Organic Flash Cycle (OFC)" Poster, BERC 2011 Innovation Expo and Energy Symposium, Oct. 20, 2011.

Ho T., "Solar Thermal Energy Research at UC Berkeley: An Advanced Organic Rankine Cycle for Improved Thermal Conversion Efficiency," Sandia National Laboratory Science and Engineering Expo Oct. 31, 2011 to Nov. 1, 2011.

Kahn A, et al. Thermal Efficiency from Organic Flash Cycle Market Assessment Report. Fall 2012.

Smith IK, Stosic N, Kovacevic A. Screw expanders increase output and decrease the cost of geothermal binary power plant systems. Geothermal Resource Council Transactions 2005;29:787-794.

Tabor H, Bronicki L. Establishing criteria for fluids for small vapor turbines. SAE Transactions 1965; 73:561-575.

Tony Ho et al., "Improved intermediate waste heat reclamation with the Organic Flash Cycle (OFC)," poster presented at the 2011 Berkeley Energy & Resources Collaborative (BERC) Symposium Innovation Expo, Oct. 20, 2011.

Tony Ho, "Solar Thermal Energy Research at UC Berkeley: An Advanced Organic Rankine Cycle for Improved Thermal Conversion Efficiency," Sandia National Laboratory Science and Engineering Expo, Oct. 31, 2011.

* cited by examiner

ORGANIC FLASH CYCLES FOR EFFICIENT POWER PRODUCTION

CROSS REFERENCE TO RELATED APPLICATIONS

This application claims priority to U.S. Provisional Patent Application No. 61/664,697, filed Jun. 26, 2012, which is herein incorporated by reference.

STATEMENT OF GOVERNMENTAL SUPPORT

This invention was made with government support under Contract No. DE-AC02-05CH11231 awarded by the U.S. Department of Energy. The government has certain rights in this invention.

FIELD

Embodiments disclosed herein relate generally to an Organic Flash Cycle (OFC), and more particularly to the use of an Organic Flash Cycle (OFC) as a vapor power cycle for thermal energy conversion.

BACKGROUND

As energy demands increase, the search for alternative energy sources to generate electricity, as well as improving existing methods to maximize efficiency, continues. In addition, greater attention to improving efficiency of all processes and reducing the amount of energy that is wasted or unused is needed. In many industries such as the ceramic, cement, metallurgical, paper and pulp, food and beverage, and oil refining industries, process heat containing significant amounts of energy is vented and lost to the environment.

SUMMARY

High quality waste energy has the potential to be efficiently converted to electricity. Its recovery would reduce thermal pollution and overall plant operating costs as the electricity generated from the waste heat could be used to power the manufacturing plant itself or be sold back to the grid. In addition to industrial processes, energy from the exit stream of gas turbines in high temperature Brayton cycles could also be used to generate electricity. In fact, utilizing this energy is the premise in many combined cycle plants.

As disclosed herein, in a basic Organic Flash Cycle (OFC) system, organic working fluids are used and brought to sufficiently high pressures such that they retain their liquid state during a heat exchange process. The heated organic working fluid is sent through a throttling valve to an evaporator, where it flash evaporates to produce a two-phase mixture; the resulting saturated vapor is separated and then expanded in a turbine to produce power. The saturated liquid is brought to the same pressure as the expanded vapor, re-mixed, and subsequently cooled to condense back to a low pressure saturated liquid.

One innovative aspect of the subject matter described in this disclosure can be implemented a basic OFC system including a pump, a heat exchanger, a flash evaporator, a turbine, a throttling valve, a mixer, and a condenser. The heat exchanger is coupled to an outlet of the pump. The flash evaporator is coupled to an outlet of the heat exchanger. The turbine is coupled to a vapor outlet of the flash evaporator. The throttling valve is coupled to a liquid outlet of the flash evaporator. The mixer is coupled to an outlet of the turbine and to an outlet of the throttling valve. The condenser is coupled to an outlet of the mixer and to an inlet of the pump. The system configured to be operable with an organic liquid.

In some embodiments, the turbine is coupled to a generator. In some embodiments, the flash evaporator includes a pressure vessel and a second throttling valve.

Another innovative aspect of the subject matter described in this disclosure can be implemented a basic OFC method including: (a) compressing an organic fluid with a pump; (b) after operation (a), heating the organic fluid by passing the organic fluid through a heat exchanger; (c) after operation (b), flash evaporating the organic fluid in a flash evaporator to generate an organic vapor; (d) driving a turbine with the organic vapor and lowering a pressure of the organic vapor to a lower pressure; (e) reducing a pressure of the organic fluid in a liquid state after operation (c) to the lower pressure by passing the organic fluid through a throttling valve; (f) mixing the organic fluid after operation (e) and the organic vapor after operation (d) in a mixer to form a mixture; (g) after operation (f), condensing the mixture to a liquid state of the organic fluid with a condenser; and, (h) after operation (i), directing the organic fluid to the pump.

In some embodiments, the turbine is coupled to a generator, and operation (d) generates electricity. In some embodiments, the organic fluid is selected from the group consisting of toluene, ethylbenzene, butylbenzene, o-xylene, m-xylene, p-xylene, tetradecamethylhexasiloxane (MD4M), tetradecamethylhexasiloxane (MD4M), decamethylcyclopentasiloxane (D5), dodecamethylpentasiloxane (MD3M), and dodecamethylcyclohexasiloxane (D6).

In some embodiments, a temperature of a liquid or a vapor used to heat the organic fluid in the heat exchanger is about 80° C. to 400° C. In some embodiments, a temperature of a liquid or a vapor used to heat the organic fluid in the heat exchanger is below about 300° C.

In some embodiments, the organic fluid is in a subcooled liquid state after operation (a). In some embodiments, the organic fluid is heated isobarically in operation (b). In some embodiments, the organic fluid remains in a liquid state in operation (b). In some embodiments, the organic fluid is in a saturated liquid state after operation (b).

Another innovative aspect of the subject matter described in this disclosure can be implemented a double flash OFC system including a pump, a heat exchanger, a first flash evaporator, a high pressure turbine, a second flash evaporator, a low pressure turbine, a throttling valve, a mixer, and a condenser. The heat exchanger is coupled to an outlet of the pump. The first flash evaporator is coupled to an outlet of the heat exchanger. The high pressure turbine is coupled to a vapor outlet of the first flash evaporator. The second flash evaporator is coupled to a liquid outlet of the first flash evaporator. The low pressure turbine is coupled to a vapor outlet of the second flash evaporator. The throttling valve is coupled to a liquid outlet of the second flash evaporator. The mixer is coupled to an outlet of the high pressure turbine, an outlet of the low pressure turbine, and an outlet of the throttling valve. The condenser is coupled to an outlet of the mixer and to an inlet of the pump. The system is configured to be operable with an organic fluid.

In some embodiments, the high pressure turbine and the low pressure turbine are coupled to a generator. In some embodiments, the first flash evaporator includes a first pressure vessel and a second throttling valve, and the second flash evaporator includes a second pressure vessel and a third throttling valve.

Another innovative aspect of the subject matter described in this disclosure can be implemented a double flash OFC method including (a) compressing an organic fluid with a pump; (b) after operation (a), heating the organic fluid by passing the organic fluid through a heat exchanger; (c) after operation (b), flash evaporating the organic fluid in a first flash evaporator to generate a high pressure organic vapor; (d) driving a high pressure turbine with the high pressure organic vapor and lowering a pressure of the high pressure organic vapor; (e) flash evaporating the organic fluid in a liquid state after operation (c) in a second flash evaporator to generate a low pressure organic vapor; (f) driving a low pressure turbine with the low pressure organic vapor and lowering a pressure of the low pressure organic vapor; (g) reducing a pressure of the organic fluid in a liquid state after operation (e) by passing the organic fluid through a throttling valve; (h) mixing the organic fluid after operation (g), the high pressure organic vapor after operation (d), and the low pressure organic vapor after operation (f) in a mixer to form an mixture; (i) condensing the mixture to a liquid state of the organic fluid with a condenser; and, (j) after operation (i), directing the organic fluid to the pump.

In some embodiments, the high pressure turbine and the low pressure turbine are coupled to a generator, and operations (d) and (f) generate electricity. In some embodiments, the organic fluid is selected from the group consisting of toluene, ethylbenzene, butylbenzene, o-xylene, m-xylene, p-xylene, tetradecamethylhexasiloxane (MD4M), tetradecamethylhexasiloxane (MD4M), decamethylcyclopentasiloxane (D5), dodecamethylpentasiloxane (MD3M), and dodecamethylcyclohexasiloxane (D6).

In some embodiments, a temperature of a liquid or a vapor used to heat the organic fluid in the heat exchanger is about 80° C. to 400° C. In some embodiments, a temperature of a liquid or a vapor used to heat the organic fluid in the heat exchanger is below about 300° C.

In some embodiments, the organic fluid is in a subcooled liquid state after operation (a). In some embodiments, the organic fluid is heated isobarically in operation (b). In some embodiments, the organic fluid remains in a liquid state in operation (b). In some embodiments, the organic fluid is in a saturated liquid state after operation (b).

Another innovative aspect of the subject matter described in this disclosure can be implemented a modified OFC system including a pump, a heat exchanger, a flash evaporator, a high pressure turbine, a throttling valve, a mixer, a low pressure turbine, and a condenser. The heat exchanger is coupled to an outlet of the pump. The flash evaporator is coupled to an outlet of the heat exchanger. The high pressure turbine is coupled to a vapor outlet of the flash evaporator. The throttling valve is coupled to a liquid outlet of the flash evaporator. The mixer is coupled to an outlet of the throttling valve and to an outlet of the high pressure turbine. The low pressure turbine is coupled to an outlet of the mixer. The condenser is coupled to an outlet of the low pressure turbine and to an inlet of the pump. The system is configured to be operable with an organic fluid.

In some embodiments, the high pressure turbine and the low pressure turbine are coupled to a generator. In some embodiments, the flash evaporator includes a pressure vessel and a second throttling value. In some embodiments, the organic fluid is selected from the group consisting of toluene, ethylbenzene, butylbenzene, o-xylene, m-xylene, p-xylene, tetradecamethylhexasiloxane (MD4M), tetradecamethylhexasiloxane (MD4M), decamethylcyclopentasiloxane (D5), dodecamethylpentasiloxane (MD3M), and dodecamethylcyclohexasiloxane (D6).

In some embodiments, the system is operable to perform a method including: (a) compressing the organic fluid with the pump; (b) after operation (a), heating the organic fluid by passing the organic fluid through the heat exchanger; (c) after operation (b), flash evaporating the organic fluid in the flash evaporator to generate a high pressure organic vapor; (d) driving the high pressure turbine with the high pressure organic vapor and lowering a pressure of the high pressure organic vapor to an intermediate pressure; (e) reducing a pressure of the organic fluid in a liquid state after operation (c) to the intermediate pressure by passing the organic fluid through the throttling valve; (f) mixing the organic fluid after operation (e) and the high pressure organic vapor after operation (d) in the mixer to form a low pressure organic vapor; (g) driving the low pressure turbine with the low pressure organic vapor and lowering a pressure of the low pressure organic vapor; (h) after operation (g), condensing the low pressure organic vapor to a liquid state of the organic fluid with the condenser; and, (i) after operation (h), directing the organic fluid to the pump.

In some embodiments, the high pressure turbine and the low pressure turbine are coupled to a generator, and operations (d) and (g) generate electricity.

In some embodiments, a temperature of a liquid or a vapor used to heat the organic fluid in the heat exchanger is about 80° C. to 400° C. In some embodiments, a temperature of a liquid or a vapor used to heat the organic fluid in the heat exchanger is below about 300° C.

In some embodiments, the organic fluid is in a subcooled liquid state after operation (a). In some embodiments, the organic fluid is heated isobarically in operation (b). In some embodiments, the organic fluid remains in a liquid state in operation (b). In some embodiments, the organic fluid is in a saturated liquid state after operation (b).

In some embodiments, the high pressure organic vapor is a saturated vapor or a superheated vapor after operation (d). In some embodiments, the organic fluid comprises a liquid and vapor mixture after operation (e). In some embodiments, the low pressure organic vapor is a saturated vapor or a superheated vapor after operation (g).

Another innovative aspect of the subject matter described in this disclosure can be implemented a modified OFC method including: (a) compressing an organic fluid with a pump; (b) after operation (a), heating the organic fluid by passing the organic fluid through a heat exchanger; (c) after operation (b), flash evaporating the organic fluid in a flash evaporator to generate a high pressure organic vapor; (d) driving a high pressure turbine with the high pressure organic vapor and lowering a pressure of the high pressure organic vapor to an intermediate pressure; (e) reducing a pressure of the organic fluid in a liquid state after operation (c) to the intermediate pressure by passing the organic fluid through a throttling valve; (f) mixing the organic fluid after operation (e) and the high pressure organic vapor after operation (d) in a mixer to form a low pressure organic vapor; (g) driving a low pressure turbine with the low pressure organic vapor and lowering a pressure of the low pressure organic vapor; (h) after operation (g), condensing the low pressure organic vapor to a liquid state of the organic fluid with a condenser; and, (i) after operation (h), directing the organic fluid to the pump.

In some embodiments, the high pressure turbine and the low pressure turbine are coupled to a generator, and operations (d) and (g) generate electricity. In some embodiments, the organic fluid is selected from the group consisting of toluene, ethylbenzene, butylbenzene, o-xylene, m-xylene, p-xylene, tetradecamethylhexasiloxane (MD4M), tetradecamethylhexasiloxane (MD4M), decamethylcyclopentasiloxane (D5), dodecamethylpentasiloxane (MD3M), and dodecamethylcyclohexasiloxane (D6).

In some embodiments, a temperature of a liquid or a vapor used to heat the organic fluid in the heat exchanger is about 80° C. to 400° C. In some embodiments, a temperature of a liquid or a vapor used to heat the organic fluid in the heat exchanger is below about 300° C.

In some embodiments, the organic fluid is in a subcooled liquid state after operation (a). In some embodiments, the organic fluid is heated isobarically in operation (b). In some embodiments, the organic fluid remains in a liquid state in operation (b). In some embodiments, the organic fluid is in a saturated liquid state after operation (b).

In some embodiments, the high pressure organic vapor is a saturated vapor or a superheated vapor after operation (d). In some embodiments, the organic fluid comprises a liquid and vapor mixture after operation (e). In some embodiments, the low pressure organic vapor is a saturated vapor or a superheated vapor after operation (g).

Another innovative aspect of the subject matter described in this disclosure can be implemented a two-phase OFC system including a pump, a heat exchanger, a two phase expander, a separator, a turbine, a throttling valve, a mixer, and a condenser. The heat exchanger is coupled to an outlet of the pump. The two phase expander is coupled to an outlet of the heat exchanger. The separator is coupled to an outlet of the two phase expander. The turbine is coupled to a vapor outlet of the separator. The throttling valve is coupled to a liquid outlet of the separator. The mixer is coupled to an outlet of the turbine and an outlet of the throttling valve. The condenser is coupled to an outlet of the mixer and to an inlet of the pump, the system configured to be operable with an organic liquid.

In some embodiments, the turbine is coupled to a generator.

Details of one or more embodiments of the subject matter described in this specification are set forth in the accompanying drawings and the description below. Other features, aspects, and advantages will become apparent from the description, the drawings, and the claims. Note that the relative dimensions of the following figures may not be drawn to scale.

DETAILED DESCRIPTION

Figure 1:
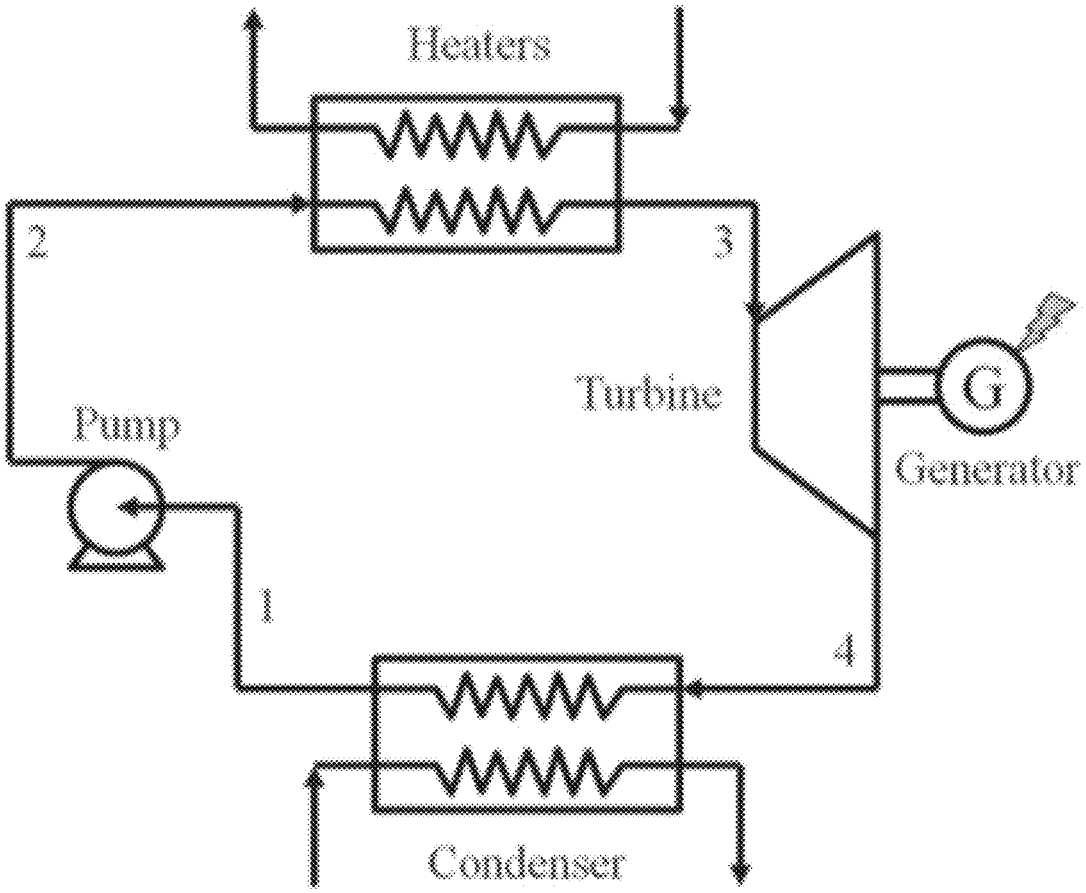
FIGS. 1 and 2 show examples of a system schematic and a temperature-entropy (T-S) diagram for a basic pure "wet" fluid Organic Rankine Cycle (ORC), a zeotropic Rankine cycle, and a transcritical Rankine cycle.

Reference will now be made in detail to some specific examples of the invention including the best modes contemplated by the inventors for carrying out the invention. Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments of the present invention may be implemented without some or all of these specific details. In other instances, well known process operations have not been described in detail in order not to unnecessarily obscure the present invention.

Various techniques and mechanisms of the present invention will sometimes be described in singular form for clarity. However, it should be noted that some embodiments include multiple iterations of a technique or multiple instantiations of a mechanism unless noted otherwise.

Introduction

As worldwide energy consumption continues to increase, the need for greater efficiency in energy production and usage becomes more critical. Maximizing the efficient conversion of heat to power in industries such as biomass, geothermal, solar thermal, and industrial processes is one avenue that can be pursued to better address this growing demand for energy.

Large power plants that operate under high temperatures typically use a Rankine Cycle to convert heat to electricity. A Rankine Cycle is a closed cycle where water absorbs heat from an external heat source and is transformed to vapor. The water vapor is then expanded in a turbine to produce electricity.

A major disadvantage of the water/steam flash cycle is that the steam, after expansion, contains a significant amount of moisture because water is a "wet" fluid. Wet fluids exhibit a saturated vapor curve on a temperature-entropy (T-S) diagram that is negatively sloped. Isentropic expansion of a "wet" fluid from its saturated vapor state will always produce a two-phase mixture with liquid droplets forming. Although large steam turbines often have isentropic efficiencies of 80% to 90%, saturated steam cycles in both geothermal and nuclear power industries still use special wet steam turbines. Wet steam turbines are constructed with expensive reinforcing materials to protect the blades from erosion and damage caused by the liquid droplets.

At low temperatures, organic fluids are more widely used to enhance performance. Organic fluids are "dry" fluids, meaning that there is no risk, after expansion in a turbine, of formation of liquid droplets that could damage turbine blades and lower the system efficiency. "Dry" and "isentropic" fluids exhibit a positively or infinitely sloped saturated vapor curve, respectively, on a temperature-entropy (T-S) diagram. Unlike "wet" fluids like water that have a negatively sloped saturated vapor curve, isentropic expansion from a saturated vapor state for "dry" and "isentropic" fluids will always result in a saturated vapor or a superheated vapor.

The Organic Rankine Cycle (ORC) is a Rankine Cycle that uses an organic fluid in place of water. ORC technology has been utilized for decades; it has been commercialized by a number of companies and is used in heat-to-power applications in the industrial, geothermal, and biomass sectors. ORC technology is generally used for low temperature and low flow thermal sources where the use of an organic fluid, in place of water, increases or maximizes performance. Some organic fluids, however, are flammable and their use may be limited to low temperature thermal sources. Typically, the ORC works well for temperatures between about 50° C. and 350° C. Above about 350° C., the use of water does not present performance disadvantages and is the preferred working fluid with higher temperature thermal sources given its economic, safety, and efficiency benefits.

Generally, in the ORC the organic fluid is pumped to increase its pressure and is then vaporized inside a heater. Within an ORC system, the heater or heat exchanger may include three separate components: a preheater, a boiler, and a superheater. In the heater, the organic liquid is heated by an external heat source, such as heat from industrial processes, geothermal energy, biomass energy, or solar applications. Through the heater, the organic liquid is vaporized into a high-pressure gas and goes through a turbine to generate electricity. After the gas expands, the fluid is condensed back into its liquid form and the closed cycle is completed.

Figure 2:
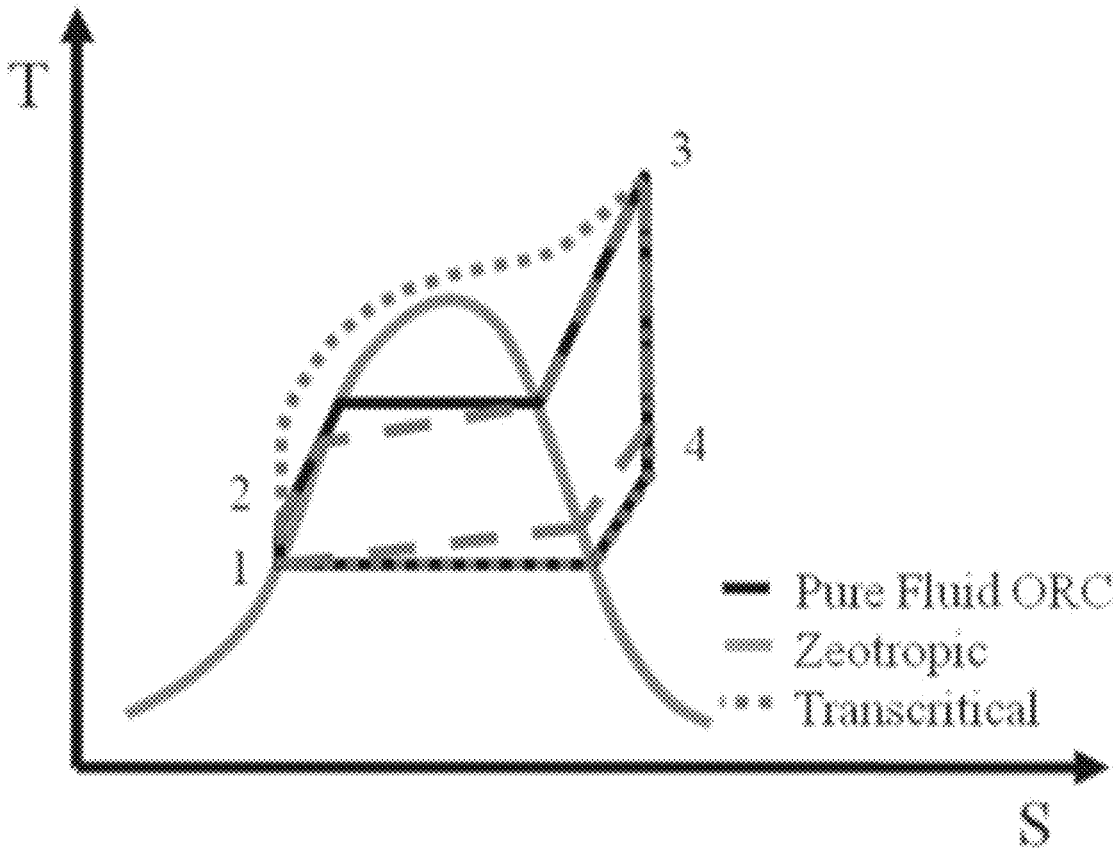

In FIGS. 1 and 2, examples of a basic ORC system schematic and its T-S diagram are shown. On the T-S diagram of FIG. 2, a basic pure "wet" fluid Organic Rankine Cycle, a zeotropic Rankine cycle, and a transcritical Rankine cycle are shown. In the ORC system, the heater/heat exchanger heats an organic liquid to a gaseous state. Therefore, the heating process requires three different components: a preheater, a boiler, and a superheater.

Basic OFC

As disclosed herein, the Organic Flash Cycle (OFC) may result in better efficiency utilization of thermal resources. One difference between the ORC and the OFC is that the OFC uses a throttling valve that manages passage of the fluid within the system. With a throttling valve, vapor is produced from a saturated liquid instead of using an evaporation process through the heater.

In embodiments of the OFC, the working fluid is always in a liquid phase as it passes through the heater. Once the liquid is hot, it may be subsequently throttled in a flash evaporator, which separates it into vapor and liquid. The separated vapor is transferred to the turbine, and the separated liquid may be throttled again to lower pressure, where it is mixed with vapor exhaust from the turbine.

One potential advantage of the OFC is that it can reduce inefficiencies in the heating process. In the ORC, the fluid in the heater goes through a phase change from liquid to vapor, and because of this phase change the heat transfer process is not as efficient as the temperature profiles of the working fluid and the heat source are more likely to mismatch. In addition, less efficient heat transfer occurs while the working fluid is in the vapor phase due to lower heat transfer coefficients. Since the heat addition in the OFC is completely in the liquid phase, the process will have higher heat transfer coefficients and more efficient heat transfer. Also, as there is no phase change in the heater of the OFC, inefficiencies of the process are primarily due to the throttling valve of the flash evaporator. The OFC also can be modified beyond its basic design to yield greater efficiency than the basic ORC.

The sizes and specifications of the components of the OFC systems disclosed herein depend upon the size of the system (e.g., the volumes of the system components) and the operating conditions (e.g., temperatures and pressures) for which the OFC system is designed. Further, each of the OFC systems disclosed herein are closed systems in which an organic fluid circulates through the system with the temperature, the pressure, and the state (e.g., gaseous state or liquid state) of the organic fluid changing depending on where it is in the system.

Figure 3A:
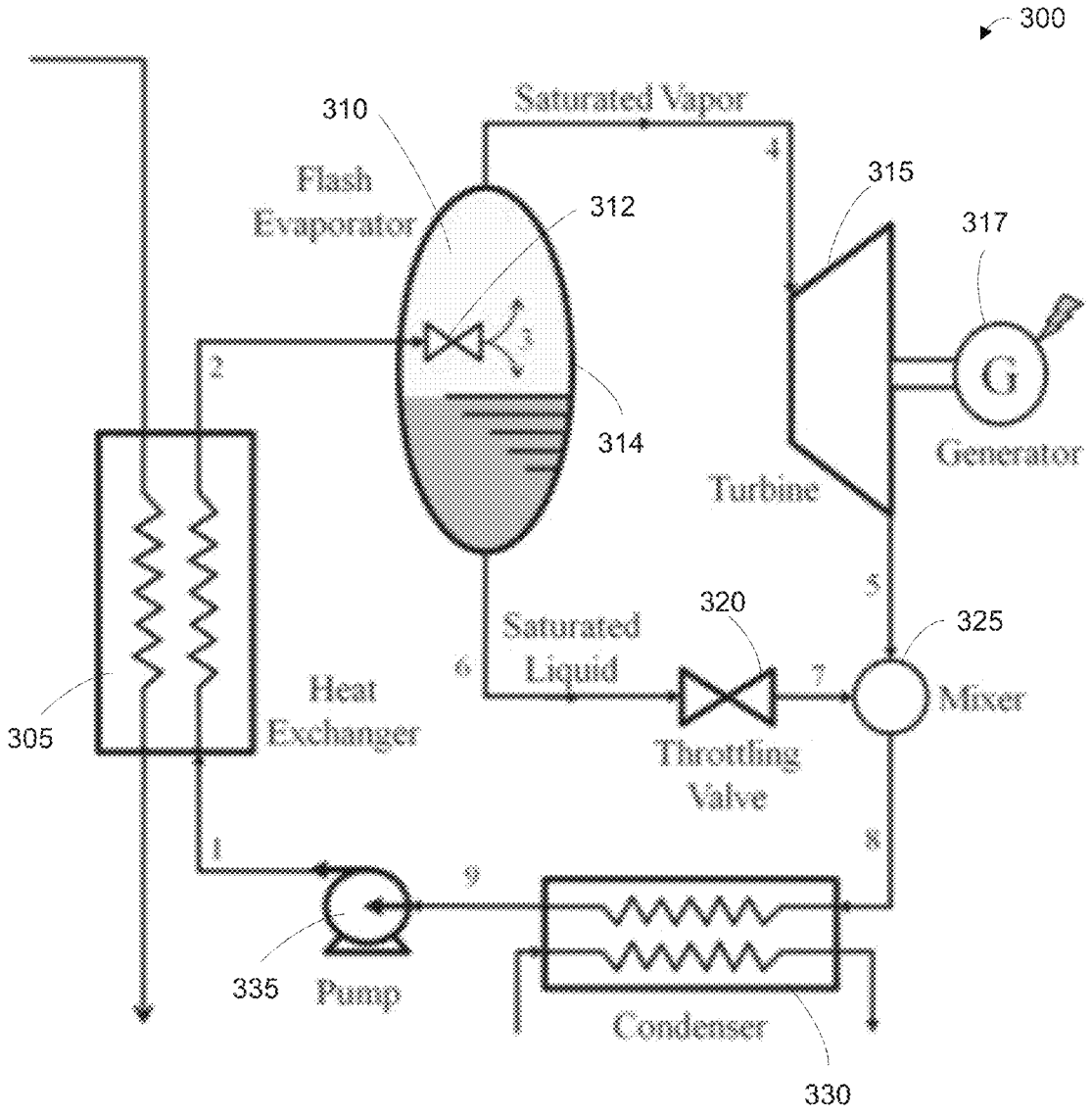
FIGS. 3A and 3B show examples of a system schematic and a T-S diagram for a basic Organic Flash Cycle (OFC).
Figure 3B:
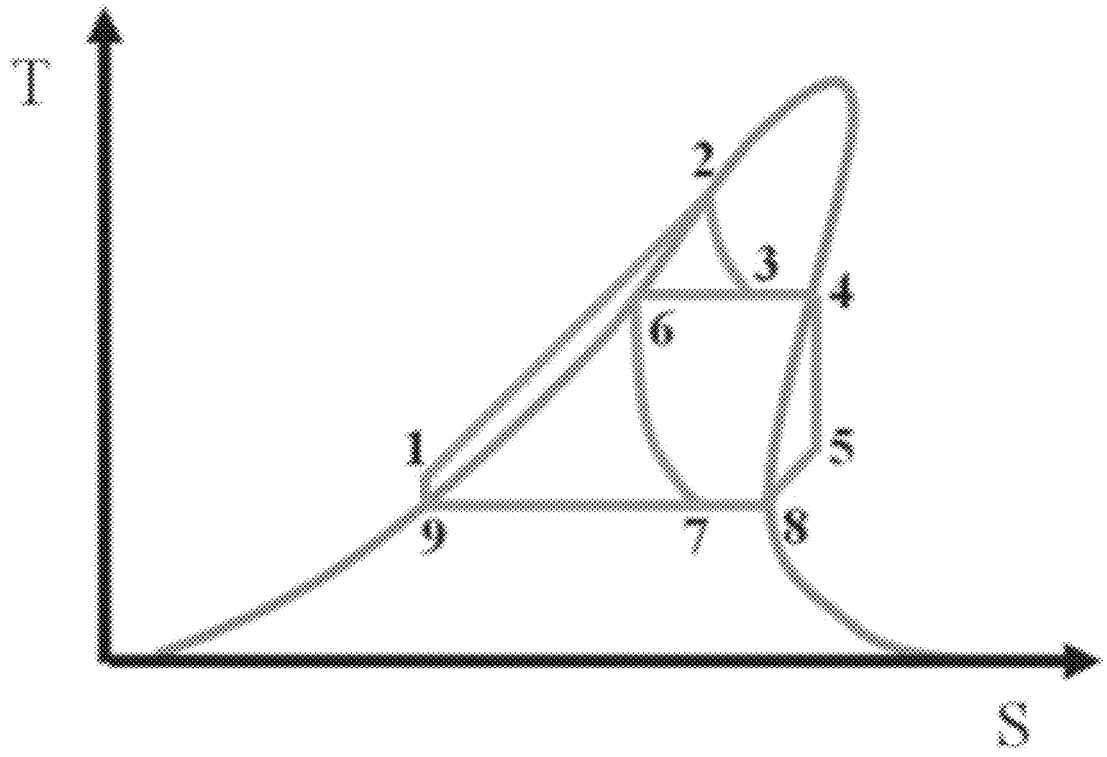

FIG. 3A shown an example of a schematic illustration of a basic OFC system. FIG. 3B shows an example of a T-S diagram of the basic OFC. Note that in FIGS. 1 and 2, a "wet" fluid had been assumed, as the slope of the saturated vapor curve is negative, whereas in FIGS. 3A and 3B, a "dry" fluid has been assumed as the slope of the saturated vapor curve is positive. It can be seen from FIG. 3A that the OFC system is slightly more complex than the basic ORC system, as shown in FIG. 1. As shown in FIG. 3A, a basic OFC system 300 includes a heat exchanger 305, a flash evaporator 310, a turbine 315, a throttling valve 320, a mixer 325, a condenser 330, and a pump 335. The components of the basic OFC system 300 may be coupled and arranged as shown in FIG. 3A.

Generally, a heat exchanger is a piece of equipment designed for efficient heat transfer from one medium to another. The heat exchanger 305 is used to heat an organic fluid. The OFC does not use an evaporator, as the cycle keeps the organic fluid in the liquid phase during the entire heat addition process. In some embodiments, a basic OFC system 300 may use a larger preheater and condenser compared to a similarly sized ORC. In some embodiments, the heat exchanger 305 is a countercurrent heat exchanger. In a countercurrent heat exchanger, two fluids flow is opposite directions to one another. An increased or maximum amount of heat can be transferred in a countercurrent heat exchanger (e.g., as compared to a co-current (parallel) heat exchanger) because the countercurrent flow maintains a slowly declining temperature difference or gradient between the fluids flowing through the heat exchanger.

Generally, a flash evaporator is operable to generate a saturated vapor and a saturated liquid when a saturated liquid undergoes a reduction in pressure by passing through a throttling device, such as a throttling valve, for example. The flash evaporator 310 includes a throttling valve 312 and a pressure vessel 314.

Generally, a turbine is a rotary mechanical device that extracts energy from a fluid flow to rotate a shaft. The shaft of the turbine may be coupled or connected to a generator to convert the mechanical energy of the shaft to electrical energy. As shown in FIG. 3A, the turbine 315 may be coupled to a generator 317 for power/electricity production using the saturated vapor from the flash evaporator 310.

The throttling valve 320 is operable to reduce the pressure of the saturated liquid from the flash evaporator 310. Generally, a mixer is a device operable to mix fluids. The mixer 325 mixes liquid from the throttling valve 320 and vapor from the turbine 315.

Generally, a condenser is a device operable to condense a substance from its gaseous to its liquid state. Typically, a condenser condenses a substance from its gaseous to its liquid state by cooling it. The condenser 330 condenses the mixture from the mixer 325 to a liquid.

Generally, a pump is a device operable to move or transport fluids (i.e., liquids or gases) by mechanical action. A pump may also be operable to pressurize (i.e., to increase the pressure of) a fluid. The pump 325 is operable to pressurize a fluid and to transport the fluid from the condenser 320 to the heat exchanger 305.

In some embodiments, the basic OFC system 300 is configured to operate with an organic fluid as the working fluid. In some embodiments, the organic fluid may comprise toluene, ethylbenzene, butylbenzene, o-xylene, m-xylene, p-xylene, tetradecamethylhexasiloxane (MD4M), tetradecamethylhexasiloxane (MD4M), decamethylcyclopentasiloxane (D5), dodecamethylpentasiloxane (MD3M), or dodecamethylcyclohexasiloxane (D6). Further, all of the OFC systems disclosed herein may operate with any of the organic fluids listed above.

As shown in FIGS. 3A and 3B, in operation the OFC system 300 brings a saturated organic liquid at a low pressure at state 9 to a high pressure at state 1 using the pump 335. In some embodiments, the organic liquid at state 9 may be slightly sub-cooled to prevent pump cavitation. Next, from state 1 to state 2, the high pressure organic liquid absorbs heat while passing though the heat exchanger 305 (e.g., from a finite thermal source). The organic liquid remains in a liquid state at state 2. The organic liquid is then flash evaporated in the flash evaporator 310 to a lower pressure liquid-vapor mixture at state 3. The liquid-vapor mixture is separated into its saturated vapor and saturated liquid components at states 4 and 6, respectively. From state 4 to state 5, the saturated vapor is expanded to the condensing pressure and work is extracted with the turbine 315. The saturated liquid is brought to a condenser pressure using the throttling valve 320 from state 6 to state 7. The liquid and vapor are then recombined in the mixer 325 and subsequently condensed back to a low pressure saturated liquid in the condenser 330 from state 8 to state 9.

It should be noted that energy in the saturated liquid (i.e., at state 6) can be further utilized by using an internal heat exchanger (IHE) as is often done in ORCs. The flashing process could also be performed in two steps to extract more work; this is sometimes done in higher temperature geothermal plants to boost power output.

Enhancements to the Basic OFC

A major source of irreversibilities and exergy destruction in the basic OFC results from the flash evaporation process (state 2 to state 3 in FIG. 3B) and the liquid throttling process (state 6 to state 7 in FIG. 3B). These two processes, respectively, cause about 13% and 6% of the total initial theoretically available work in the finite thermal energy source stream to be destroyed for aromatic hydrocarbon working fluids. As described below, several modifications to the basic OFC are possible that mitigate the exergy destroyed by these two processes. Four variants of the OFC are the "Modified OFC," the "Double flash OFC," the "Two-phase OFC," and the "Modified Two-phase OFC."

The Double Flash OFC.

The motivation of the double flash OFC is similar to that of the double flash steam cycle in geothermal energy. By splitting the flash evaporation process into two steps instead of one, more of the fluid is vaporized and consequently, more of the fluid can be expanded for power production.

Figure 4A:
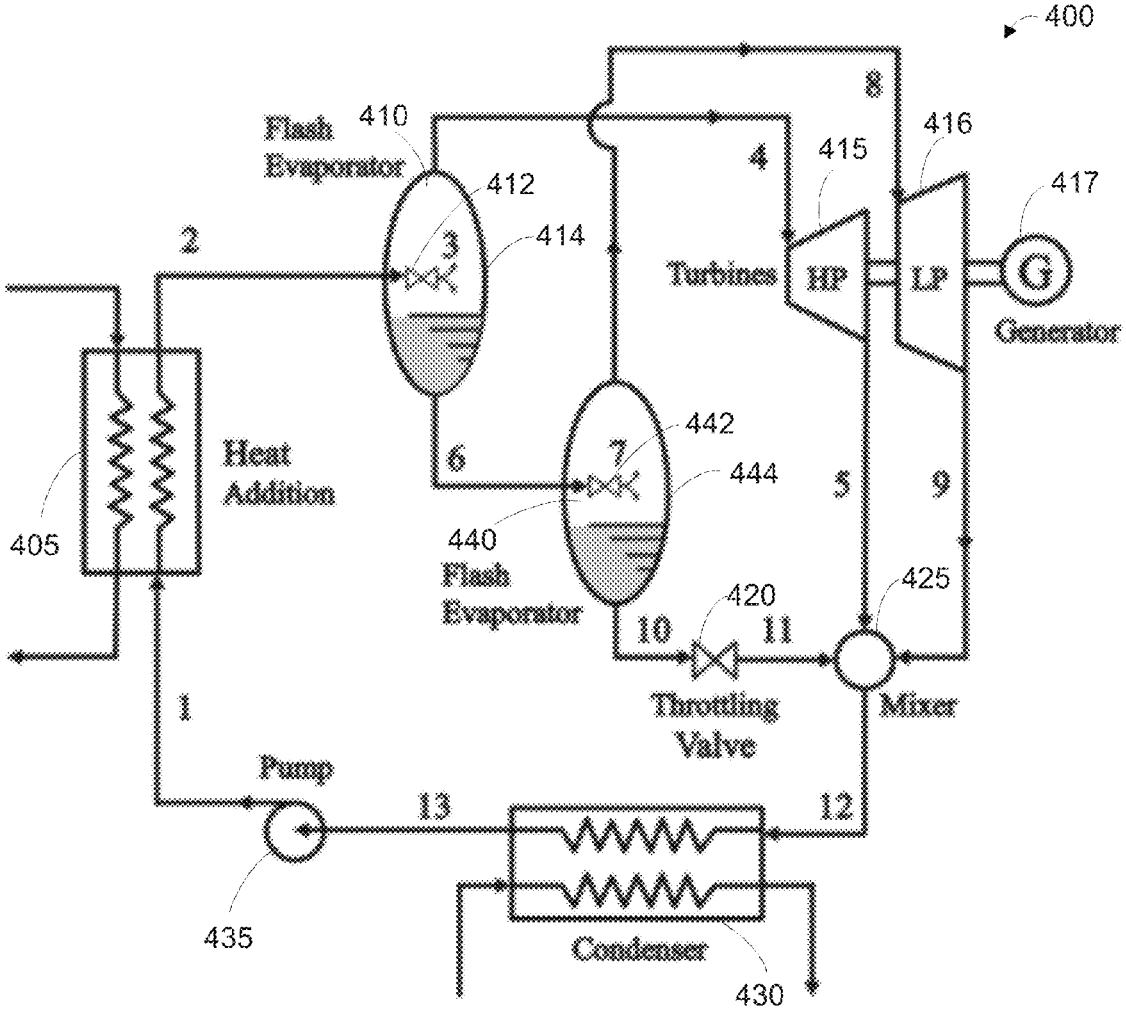
FIGS. 4A and 4B show examples of a system schematic and a T-S diagram for a double flash OFC.
Figure 4B:
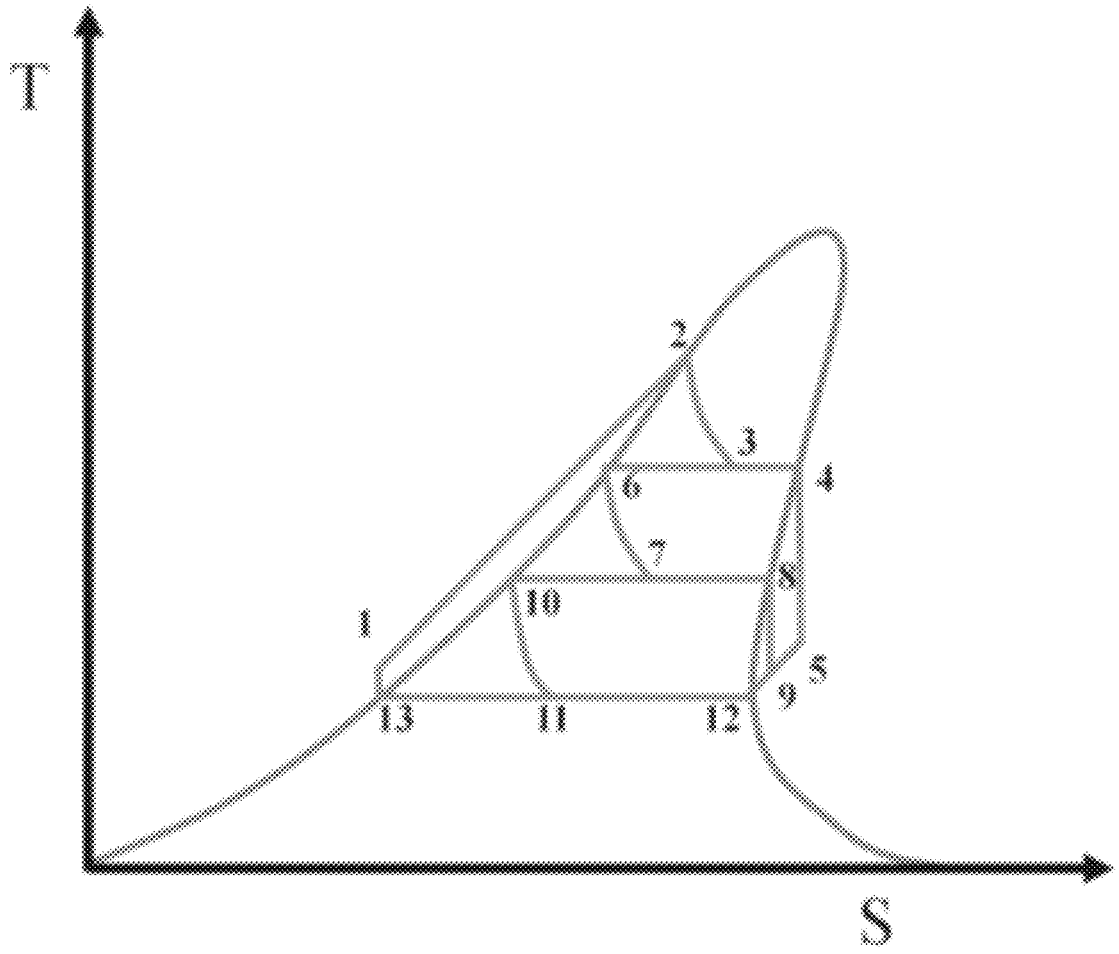

FIG. 4A shown an example of a schematic illustration of a double flash OFC system. FIG. 4B shows an example of a T-S diagram of the double flash OFC. As shown in FIG. 4A, a double flash OFC system 400 includes a heat exchanger 405, a first flash evaporator 410, a second flash evaporator 440, a high pressure turbine 415, a low pressure turbine 416, a throttling valve 420, a mixer 425, a condenser 430, and a pump 435. The components of the double flash OFC system 400 may be coupled and arranged as shown in FIG. 4A.

The first flash evaporator 410 includes a throttling valve 412 and a pressure vessel 414. The second flash evaporator 440 includes a throttling valve 442 and a pressure vessel 444. The high pressure turbine 415 and the low pressure turbine 416 may be coupled to a generator 417 for power/electricity production. In some embodiments, the high pressure turbine 415 and the low pressure turbine 416 are coupled to a single shaft that is coupled to the generator 417. In some embodiments, the high pressure turbine 415 and the low pressure turbine 416 may be single-stage turbines.

As shown in FIGS. 4A and 4B, in operation the double flash OFC system 400 operates in a similar manner as the OFC system 300 shown in FIGS. 3A and 3B, with an additional flash evaporation operation. In the double flash OFC system 400, the expansion process occurs in two stages, one at a high pressure after a first flash evaporation step (state 2 to state 3 in FIG. 4B) and a secondary expansion stage occurs at a lower, intermediate pressure after the second flash evaporation step (state 6 to state 7 in FIG. 4B). Geothermal studies have shown that by introducing a secondary flash step, the double flash steam cycle can generate 15% to 20% more power than the single flash steam cycle for the same geofluid.

In operation, the double flash OFC system 400 brings a saturated organic liquid at a low pressure at state 13 to a high pressure at state 1 using the pump 435. In some embodiments, the organic liquid at state 13 may be slightly sub-cooled to prevent pump cavitation. Next, from state 1 to state 2, the high pressure organic liquid absorbs heat while passing though the heat exchanger 405 (e.g., from a finite thermal source). The organic liquid is then flash evaporated in the flash evaporator 410 to a lower pressure liquid-vapor mixture at state 3. The liquid-vapor mixture is separated into its saturated vapor and saturated liquid components at states 4 and 6, respectively. From state 4 to state 5, the saturated vapor is expanded to the condensing pressure and work is extracted with the high pressure turbine 415. The saturated liquid is flash evaporated a second time in the flash evaporator 440. The liquid-vapor mixture is separated into its saturated vapor and saturated liquid components at states 8 and 10, respectively. From state 8 to state 9, the saturated vapor is expanded to the condensing pressure and work is extracted with the low pressure turbine 416. The saturated liquid from the flash evaporator 440 is brought to a condenser pressure using the throttling valve 420 from state 10 to state 11. The liquid and vapor are then recombined in the mixer 425 and subsequently condensed back to a low pressure saturated liquid in the condenser 430 from state 12 to state 13.

The Modified OFC.

It was found that the "drying" nature of the organic working fluids causes a substantial degree of superheat at the turbine exit, particularly for siloxanes. Siloxanes are molecularly complex, and have been shown to result in less positively sloped saturated vapor curves on a T-S diagram and correspondingly more superheat after expansion from a saturated vapor state. The modified OFC is designed with this observation in mind.

In some embodiments of a modified OFC, turbine expansion is performed in two stages. After the fluid is separated into liquid and vapor in the flash evaporator, the vapor goes through a first turbine. After expansion in the first turbine, the vapor exhaust is mixed with the liquid from the flash evaporator in a mixer. In the mixer, the superheated vapor and saturated liquid produce a saturated vapor that can be used again in a second turbine. The liquid is condensed in the condenser once it exits the second turbine and the cycle is completed.

Figure 5A:
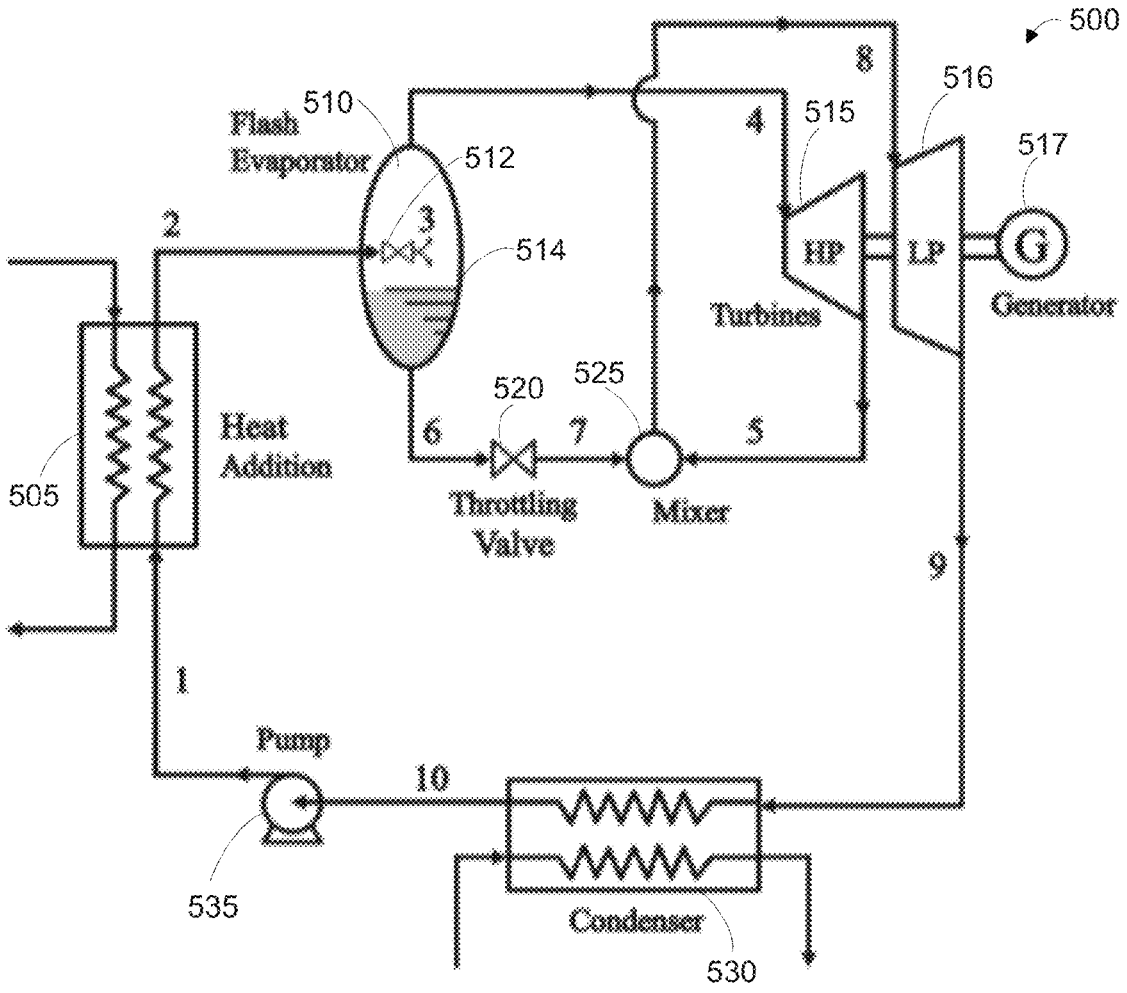
FIGS. 5A and 5B show examples of a system schematic and a T-S diagram for a modified OFC.
Figure 5B:
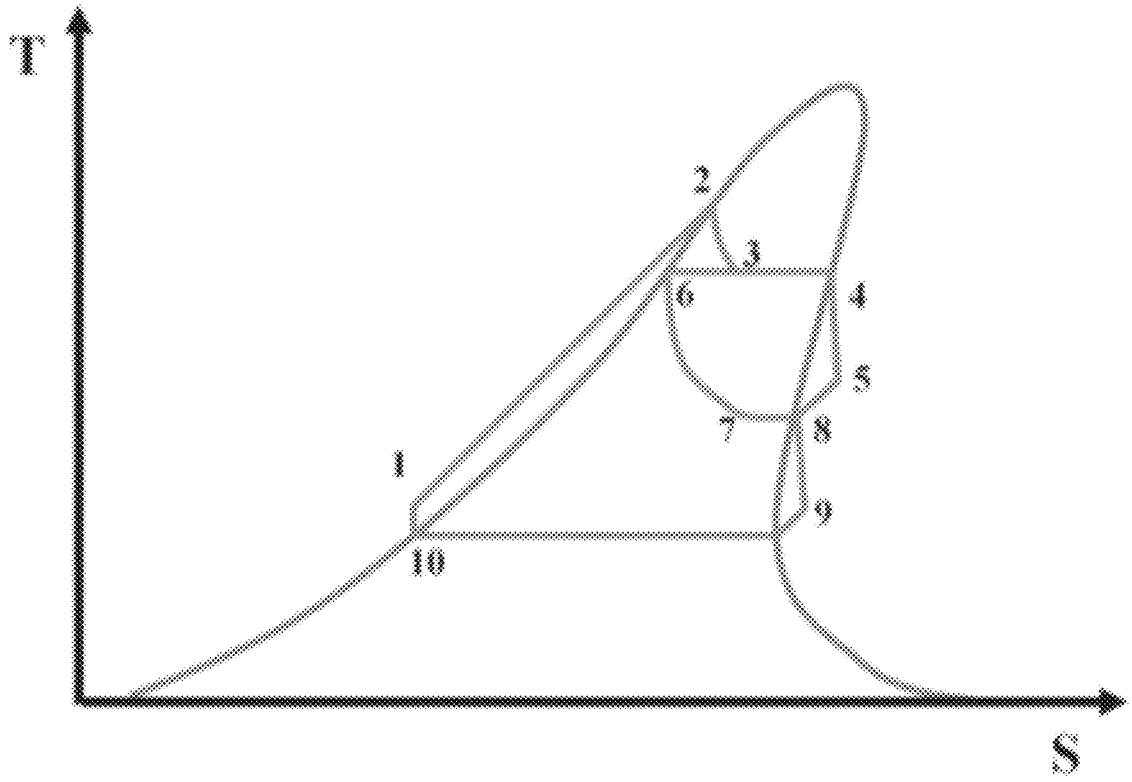
Figure 5C:
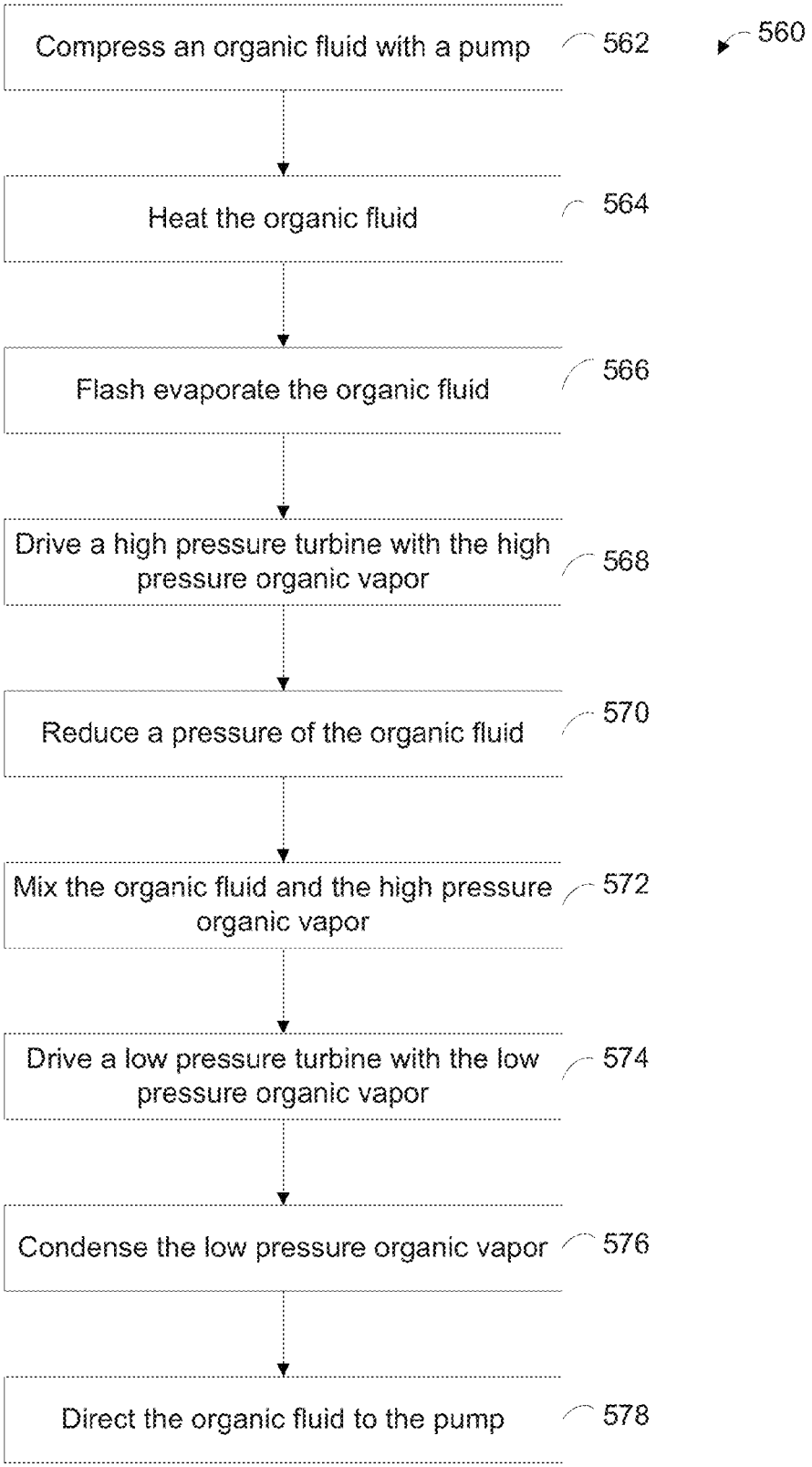
FIG. 5C shows an example of a flow diagram illustrating the operation of a modified OFC system.

FIG. 5A shown an example of a schematic illustration of a modified OFC system. FIG. 5B shows an example of a T-S diagram of the modified OFC. FIG. 5C shows an example of a flow diagram illustrating the operation of a modified OFC system. As shown in FIG. 5A, a modified OFC system 500 includes a heat exchanger 505, a flash evaporator 510, a high pressure turbine 515, a low pressure turbine 516, a throttling valve 520, a mixer 525, a condenser 530, and a pump 535. The components of the modified OFC system 500 may be coupled and arranged as shown in FIG. 5A.

The flash evaporator 510 includes a throttling valve 512 and a pressure vessel 514. The high pressure turbine 515 and the low pressure turbine 516 may be coupled to a generator 517 for power/electricity production. In some embodiments, the high pressure turbine 515 and the low pressure turbine 516 are coupled to a single shaft that is coupled to the generator 517. In some embodiments, the high pressure turbine 515 and the low pressure turbine 516 may be single-stage turbines.

As shown in FIG. 5C, a method 560 of operation of a modified OFC system begins with operation 562 of compressing an organic fluid with a pump (state 10 to state 1). In some embodiments, the organic fluid comprises toluene, ethylbenzene, butylbenzene, o-xylene, m-xylene, p-xylene, tetradecamethylhexasiloxane (MD4M), tetradecamethylhexasiloxane (MD4M), decamethylcyclopentasiloxane (D5), dodecamethylpentasiloxane (MD3M), or dodecamethylcyclohexasiloxane (D6). In some embodiments, the organic fluid is in a subcooled liquid state after operation 562. A subcooled liquid is a liquid that is below its saturation temperature.

After operation 562, in operation 564, the organic fluid is heated by passing the organic fluid through a heat exchanger (state 1 to state 2). In some embodiments, a temperature of a liquid or a vapor used to heat the organic fluid in the heat exchanger is about 80° C. to 400° C. or below about 300° C. In some embodiments, the organic fluid is heated isobarically (i.e., at a constant pressure) in operation 564. In some embodiments, the organic fluid remains in a liquid state in operation 564. In some embodiments, the organic fluid is in a saturated liquid state after operation 564. A saturated liquid is a liquid which is at its saturation pressure and saturation temperature; i.e., a liquid which is at its boiling point for any given pressure.

After operation 564, in operation 566, the organic fluid is flash evaporated in a flash evaporator. Flash evaporating the organic fluid produces a high pressure organic vapor and an organic liquid (state 2 to state 3). The high pressure organic vapor and the organic liquid are saturated fluids. In some embodiments, gravity separates the organic liquid and the high pressure organic vapor, with the denser liquid (state 4) flowing out of a bottom of the flash evaporator and the less dense vapor (state 5) flowing out of the top of the flash evaporator.

In operation 568, a high pressure turbine is driven with the high pressure organic vapor (state 4 to state 5). The high pressure turbine is driven with the high pressure organic vapor by expanding the high pressure organic vapor through the high pressure turbine. Operation 568 also lowers the pressure of the high pressure organic vapor to an intermediate pressure. In some embodiments, the high pressure organic vapor is a saturated vapor or a superheated vapor after operation 568. A saturated vapor is a vapor which is at its saturation pressure and saturation temperature. A superheated vapor is a vapor at a temperature that is higher than its vaporization (boiling) point at the absolute pressure where the temperature measurement is taken; therefore, the vapor can cool (i.e., lose internal energy) by some amount, resulting in a lowering of its temperature without changing state (i.e., condensing) from a gas to a mixture of saturated vapor and liquid.

In operation 570, a pressure of the organic fluid in a liquid state from the flash evaporator is reduced to an intermediate pressure by passing the organic fluid through a throttling valve (state 6 to state 7). In some embodiments, the organic fluid comprises a liquid and vapor mixture after operation 570.

In operation 572, the organic fluid after operation 570 and the high pressure organic vapor after operation 568 are mixed in a mixer to form a low pressure organic vapor (states 5 and 7 to state 8). In some embodiments, the mixing process is an isobaric mixing process.

In operation 574, a low pressure turbine is driven with the low pressure organic vapor (state 8 to state 9). The low pressure turbine is driven with the low pressure organic vapor by expanding the low pressure organic vapor through the low pressure turbine. Operation 574 also lowers a pressure of the low pressure organic vapor. In some embodiments, the low pressure organic vapor is a saturated vapor or a superheated vapor after operation 574.

After operation 574, in operation 576, the low pressure organic vapor is condensed to a liquid state of the organic fluid with a condenser (state 9 to state 10). In the condensation process, the low pressure organic vapor releases heat or energy. In some embodiments, the organic fluid is a saturated liquid after operation 576.

After operation 576, in operation 578, the organic fluid is directed to the pump. The organic fluid can then flow through the method 560 again, starting with operation 562 in which the organic fluid is compressed with the pump. In some embodiments, the high pressure turbine and the low pressure turbine are coupled to a generator, with operations 568 and 574 generating electricity.

One advantage of a modified OFC system is that more of the organic fluid goes through the expansion process to produce work. In the basic OFC shown in FIGS. 3A and 3B, the saturated liquid after the flash evaporation operation is throttled to the condensing pressure and never used to produce work; the energy in the saturated liquid is essentially lost. In the modified OFC, the saturated liquid does produce work after it recombines with the high pressure turbine exhaust and is then expanded in the low pressure turbine (state 8 to state 9 in FIG. 5B).

Another advantage of the modified OFC system is that the organic vapor is less superheated at the low pressure turbine exit. This can be seen more clearly in the T-S diagram of FIG. 5B. Expansion to the condenser pressure from a saturated vapor at a lower pressure (state 8) produces a state less superheated than expansion from a saturated vapor at a higher pressure (state 4). Effectively, the excess superheat due to expansion of a "dry" fluid is used to vaporize more fluid and generate more work. Also, from Carnot considerations, the thermal efficiency of the cycle increases because heat is now being rejected at a lower temperature since the fluid is at a lower temperature prior to the condenser (state 9). These two advantages allow for decreased exergy destruction in the condenser and throttling valve compared to the basic OFC.

Yet another advantage of the modified OFC system is that the organic fluid is flashed to a lower quality which results in the liquid being at a higher temperature and pressure prior to the high pressure turbine. This also results in reduced exergy destruction in the flash evaporation process since the separated liquid can still be used to produce power in the low pressure turbine.

The Two-Phase OFC.

In some embodiments of a two-phase OFC, the flash expander in the basic OFC (state 2 to state 3 in FIG. 3B) is replaced with a two-phase expander. In some embodiments, a two-phase OFC may resemble the so-called "Smith Cycle," which used an n-pentane working fluid.

Figure 6A:
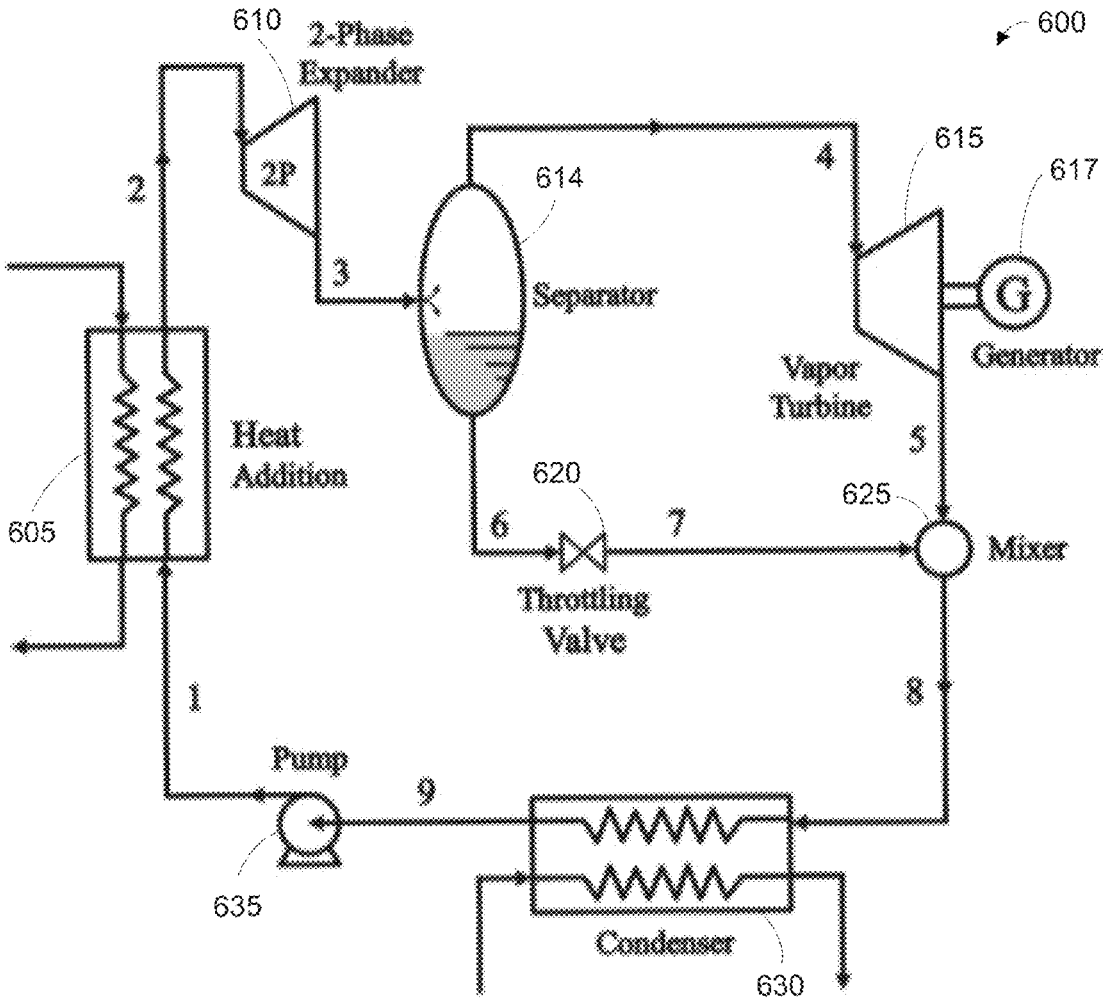
FIGS. 6A and 6B show examples of a system schematic and a T-S diagram for a two-phase OFC.
Figure 6B:
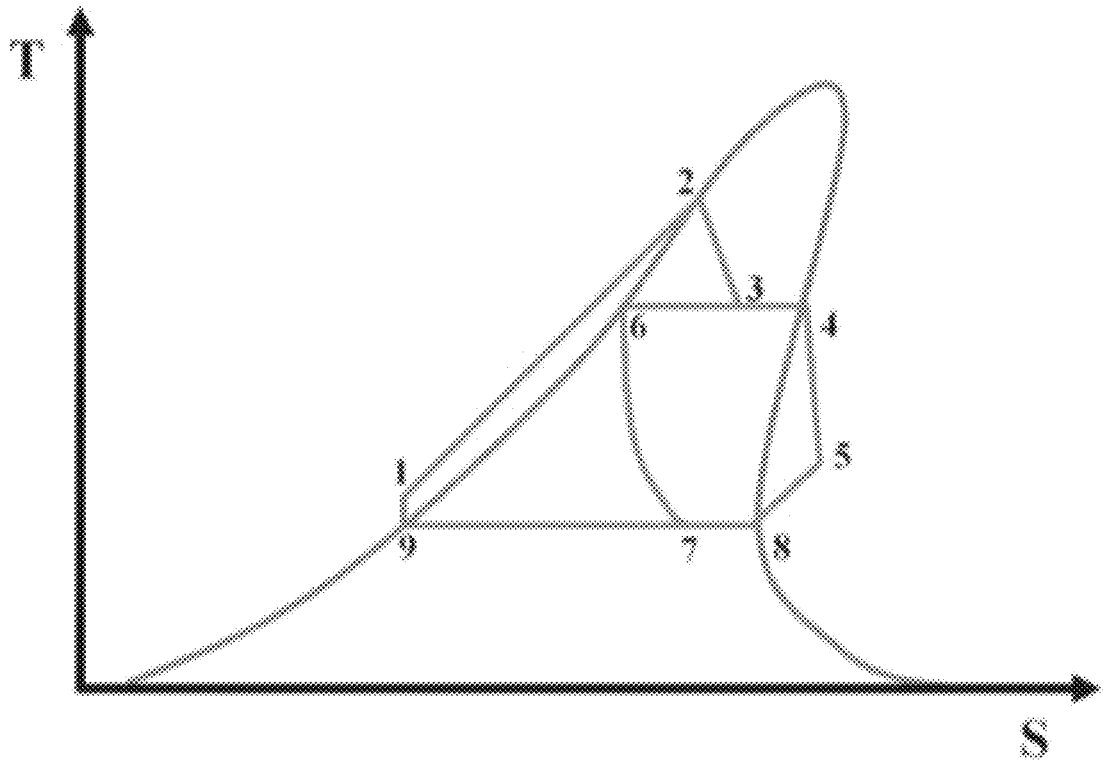

FIG. 6A shown an example of a schematic illustration of a two-phase OFC system. FIG. 6B shows an example of a T-S diagram of the two-phase OFC. As shown in FIG. 6A, a two-phase OFC system 600 includes a heat exchanger 605, a two-phase expander 610, a separator 614, a turbine 615, a throttling valve 620, a mixer 625, a condenser 630, and a pump 635. The components of the two-phase OFC system 600 may be coupled and arranged as shown in FIG. 6A.

In some embodiments, the separator 614 may comprise a pressure vessel. The turbine 615 may be coupled to a generator 617 for power/electricity production. The two-phase expander 610 may be coupled to a second generator (not shown) for power/electricity production.

Traditionally, the task of designing a reliable and efficient two-phase turbine has been challenging because it requires the turbine to be able to handle a fluid with both liquid and vapor behaviors. Tailoring the turbine specifically to one phase or the other is thus not appropriate in this case, which has made it difficult to achieve a suitable design. In a sense, two-phase expanders are similar to throttling valves, except they have the ability to recover some of the energy dissipated by the throttling process (capturing energy associated with the rapid expansion of the vapor after flashing from a liquid as the fluid drops to a lower pressure). Presently, radial inflow turbine manufacturers have reported that isentropic efficiencies of about 70% can be achieved reliably in the two-phase regime. Significant advances have also been achieved recently for screw-type and scroll-type expanders.

As shown in FIGS. 6A and 6B, in some embodiments, the operation of the two-phase OFC system 600 is similar to the operation of the basic OFC system 300 shown in FIG. 3. In the operation of the two-phase OFC system 600, the organic fluid passes through the two-phase expander 610 and work is extracted. The liquid-vapor mixture at state 3 is separated into its saturated vapor and saturated liquid components at states 4 and 6, respectively. In some embodiments, the remainder of the operations of the two-phase OFC system 600 may be similar to the operations of the basic OFC system 300.

The Modified Two-Phase OFC.

Combining the embodiments described with respect to FIGS. 5A, 5B, 5C, 6A, and 6B, the modified two-phase OFC replaces the throttling valve in the flash evaporation process with a two-phase expander. It also uses two separate vapor expansion stages to de-superheat the exhaust from the high pressure turbine and generate more vapor to produce work.

Figure 7A:
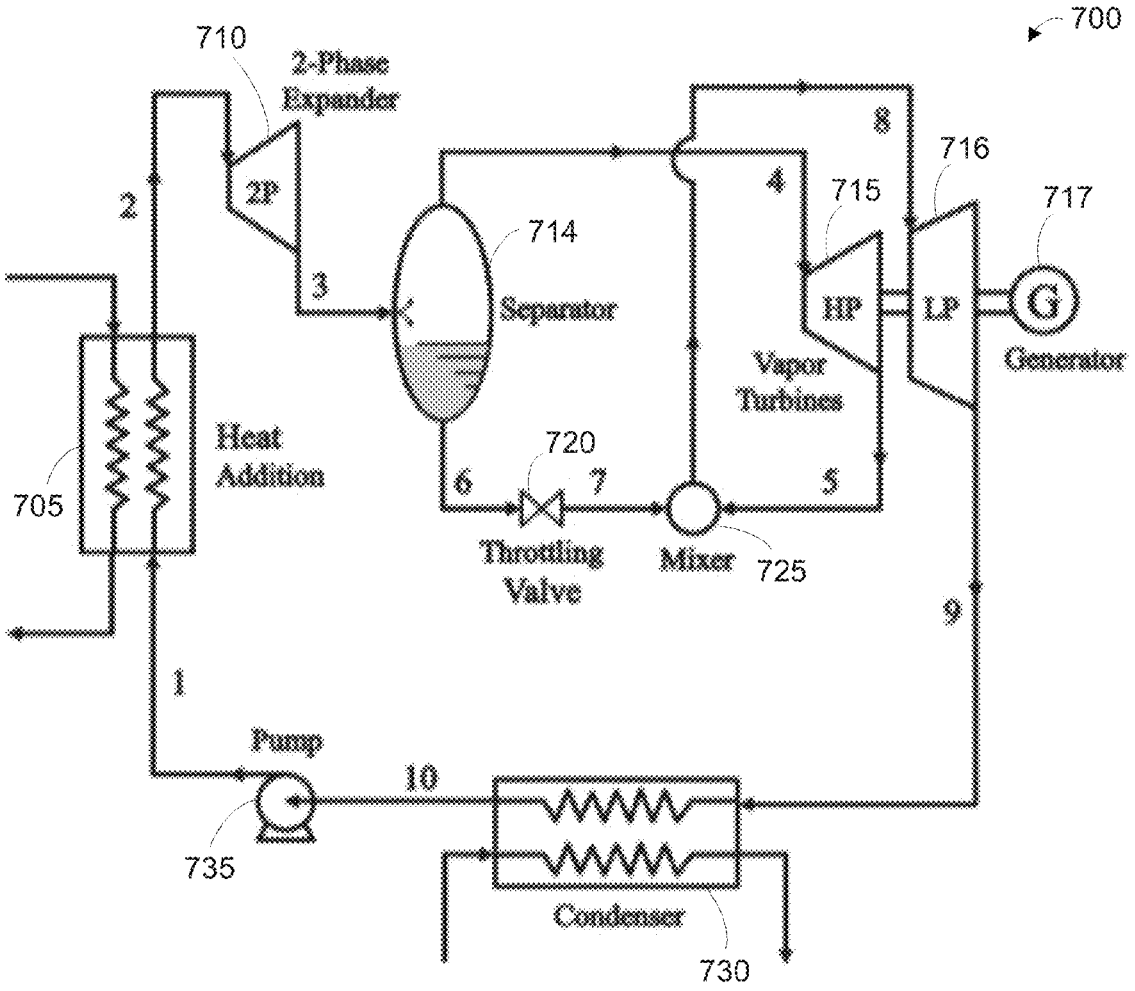
FIGS. 7A and 7B show examples of a system schematic and a T-S diagram for a modified two-phase OFC.
Figure 7B:
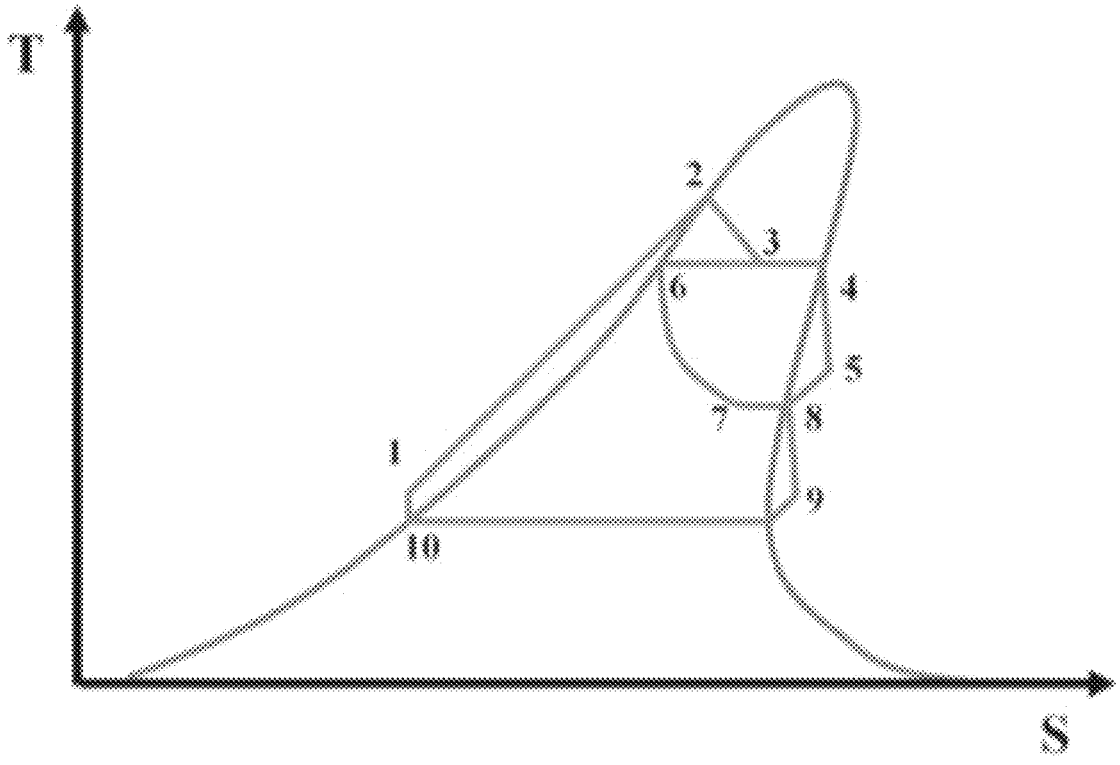

FIG. 7A shown an example of a schematic illustration of a modified two-phase OFC system. FIG. 7B shows an example of a T-S diagram of the modified two-phase OFC. As shown in FIG. 7A, a modified two-phase OFC system 700 includes a heat exchanger 705, a two-phase expander 710, a separator 714, a high pressure turbine 715, a low pressure turbine 716, a throttling valve 720, a mixer 725, a condenser 730, and a pump 735. The components of the modified two-phase OFC system 700 may be coupled and arranged as shown in FIG. 7A.

In some embodiments, the separator 714 may comprise a pressure vessel. The high pressure turbine 715 and the low pressure turbine 716 may be coupled to a generator 717 for power/electricity production. The two-phase expander 710 may be coupled to a second generator (not shown) for power/electricity production.

In some embodiments, the modified two-phase OFC system 700 includes operations as described above with respect to the modified OFC (FIGS. 5A, 5B, and 5C) and the two-phase OFC (FIGS. 6A and 6B). Embodiments of the modified two-phase OFC may produce more power than other embodiments of OFCs disclosed herein. It is noted, however, that embodiments of the modified two-phase OFC system are more complex than other OFC systems disclosed herein. For example, in some embodiments, a modified two-phase OFC 700 includes three expansion operations, performed by the two-phase expander 710, the high pressure turbine 715, and the low pressure turbine 716. The increase power output of a modified two-phase OFC system 700 should be compared with the cost of additional equipment when determining the merits of the modified two-phase OFC system.

Results and Discussion

A combination of modern equations of state was used to calculate working fluid thermodynamic properties of the various embodiments, as described in the papers "Comparison of the Organic Flash Cycle (OFC) to other advanced vapor cycles for intermediate and high temperature waste heat reclamation and solar thermal energy," Ho, Tony, et al., Energy 42 (2012) 213-223, and "Increased power production through enhancements to the Organic Flash Cycle (OFC)," Ho, Tony, et al., Energy 45 (2012), 686-695. Both papers are herein incorporated by reference.

Results showed that in some embodiments the modified OFC can produce more power than the double flash OFC. The modified OFC also may be more attractive than the double flash OFC in terms of system simplicity because a second flash evaporator is not used. In some embodiments, the modified OFC configuration can produce more power because all the flow is expanded through the low pressure turbine. In addition, less energy may be lost in the condenser because the fluid is less superheated at the low pressure turbine exit and energy from the separated saturated liquid after flash evaporation is also utilized to produce power.

Combining the advantages of the modified OFC and the two-phase OFC, the modified two-phase OFC showed the greatest potential for increased power output. For aromatic hydrocarbon working fluids, the modified two-phase OFC produced approximately 76% of the theoretically available power initially in the finite thermal energy source. For the same finite thermal energy source, the modified two-phase OFC produced approximately 20% more power than the optimized conventional ORC. Although this cycle can generate substantially more power, this embodiment needs to be evaluated with respect to the additional complexity and equipment costs.

The modified OFC may be an attractive compromise between high power output and additional equipment costs. By adding an additional low pressure turbine to the basic OFC, a 10% to 12% increase in power output compared to the optimized ORC may be achieved for aromatic hydrocarbons. The heat exchangers for the modified OFC could also be less expensive than for the basic OFC because more power is being produced, which reduces the total heat rejection rate in the condenser and subsequently decreases the necessary heat transfer area for the condenser.

CONCLUSION

Several different embodiments of an Organic Flash Cycle (OFC) disclosed herein may improve power output from a specific flow rate of a given finite thermal energy reservoir. Some of the sources of inefficiency in the basic OFC configuration, including irreversibilities generated by the flash evaporation process and the high superheat at the turbine exit, may be reduced with enhancements to the basic OFC configuration disclosed herein.

In the foregoing specification, the invention has been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

We claim:

1. A system comprising:

a pump;

a heat exchanger, the heat exchanger coupled to an outlet of the pump, the heat exchanger operable to receive an organic fluid from the pump and to heat the organic fluid;

a flash evaporator, the flash evaporator coupled to an outlet of the heat exchanger, the flash evaporator operable to receive the heated organic fluid from the heat exchanger, the flash evaporator operable to flash evaporate the heated organic fluid to generate a high pressure organic vapor and an organic liquid;

a high pressure turbine, the high pressure turbine coupled to a vapor outlet of the flash evaporator, the high pressure turbine operable to be driven with the high pressure organic vapor received from the flash evaporator and to generate an intermediate pressure organic vapor;

a throttling valve, the throttling valve coupled to a liquid outlet of the flash evaporator, the throttling valve operable to reduce a pressure of the organic liquid received from the flash evaporator;

a mixer, the mixer coupled to an outlet of the throttling valve and to an outlet of the high pressure turbine, the mixer operable to mix the intermediate pressure organic vapor received from the high pressure turbine and the reduced pressure organic liquid received from the throttling valve to form a low pressure organic vapor;

a low pressure turbine, the low pressure turbine coupled to an outlet of the mixer, the low pressure turbine operable to be driven with the low pressure organic vapor received from the mixer and to reduce a pressure of the low pressure organic vapor; and a condenser, the condenser coupled to an outlet of the low pressure turbine and to an inlet of the pump, the condenser operable to receive the reduced pressure low pressure organic vapor from the low pressure turbine and to generate a liquid state of the organic fluid, the condenser operable to deliver the liquid state of the organic fluid to the pump.

2. The system of claim 1, wherein the high pressure turbine and the low pressure turbine are coupled to a generator.

3. The system of claim 1, wherein the flash evaporator includes a pressure vessel and a second throttling value.

4. The system of claim 1, wherein the organic fluid is selected from a group consisting of toluene, ethylbenzene, butylbenzene, o-xylene, m-xylene, p-xylene, tetradecamethylhexasiloxane (MD4M), tetradecamethylhexasiloxane (MD4M), decamethylcyclopentasiloxane (D5), dodecamethylpentasiloxane (MD3M), and dodecamethylcyclohexasiloxane (D6).

5. A method using the system of claim 1, the method comprising:

(a) compressing the organic fluid with the pump;

(b) delivering the organic fluid to the heat exchanger and heating the organic fluid by passing the organic fluid through the heat exchanger;

(c) delivering the heated organic fluid to the flash evaporator and flash evaporating the heated organic fluid to generate the high pressure organic vapor and the organic liquid;

(d) driving the high pressure turbine with the high pressure organic vapor from the flash evaporator and lowering a pressure of the high pressure organic vapor to form the intermediate pressure organic vapor;

(e) reducing the pressure of the organic liquid from the flash evaporator by passing the organic liquid through the throttling valve;

(f) mixing the reduced pressure organic liquid from the throttling valve and the intermediate pressure organic vapor from the high pressure turbine in the mixer to form the low pressure organic vapor;

(g) driving the low pressure turbine with the low pressure organic vapor from the mixer and reducing the pressure of the low pressure organic vapor;

(h) condensing the reduced pressure low pressure organic vapor from the low pressure turbine to the liquid state of the organic fluid with the condenser; and (i) delivering the liquid state of the organic fluid from the condenser to the pump.

6. The method of claim 5, wherein the high pressure turbine and the low pressure turbine are coupled to a generator, and wherein operations (d) and (g) generate electricity.

7. The method of claim 5, wherein a temperature of a liquid or a vapor used to heat the organic fluid in the heat exchanger is about 80° C. to 400° C.

8. The method of claim 5, wherein a temperature of a liquid or a vapor used to heat the organic fluid in the heat exchanger is below about 300° C.

9. The method of claim 5, wherein the organic fluid is in a subcooled liquid state after operation (a).

10. The method of claim 5, wherein the organic fluid is heated isobarically in operation (b).

11. The method of claim 5, wherein the organic fluid remains in a liquid state in operation (b).

12. The method of claim 5, wherein the heated organic fluid generated in operation (b) is in a saturated liquid state.

13. The method of claim 5, wherein the intermediate pressure organic vapor generated in operation (d) comprises a saturated vapor or a superheated vapor.

14. The method of claim 5, wherein the reduced pressure organic liquid generated in operation (e) comprises a liquid and vapor mixture.

15. The method of claim 5, wherein the reduced pressure low pressure organic vapor generated in operation (g) comprises a saturated vapor or a superheated vapor.

16. A method comprising:

(a) compressing an organic fluid with a pump;

(b) delivering the organic fluid from the pump to a heat exchanger and heating the organic fluid by passing the organic fluid through the heat exchanger;

(c) delivering the organic fluid from the heat exchanger to a flash evaporator and flash evaporating the organic fluid to generate a high pressure organic vapor and an organic liquid;

(d) driving a high pressure turbine with the high pressure organic vapor from the flash evaporator and lowering a pressure of the high pressure organic vapor to form an intermediate pressure organic vapor;

(e) reducing a pressure of the organic liquid from the flash evaporator by passing the organic liquid through a throttling valve;

(f) mixing the reduced pressure organic liquid from the throttling valve and the intermediate pressure organic vapor from the high pressure turbine in a mixer to form a low pressure organic vapor;

(g) driving a low pressure turbine with the low pressure organic vapor from the mixer and reducing a pressure of the low pressure organic vapor;

(h) condensing the reduced pressure low pressure organic vapor from the low pressure turbine to a liquid state of the organic fluid with a condenser; and (i) delivering the liquid state of the organic fluid from the condenser to the pump.

17. The method of claim 16, wherein the high pressure turbine and the low pressure turbine are coupled to a generator, and wherein operations (d) and (g) generate electricity.

18. The method of claim 16, wherein the organic fluid is selected from a group consisting of toluene, ethylbenzene, butylbenzene, o-xylene, m-xylene, p-xylene, tetradecamethylhexasiloxane (MD4M), tetradecamethylhexasiloxane (MD4M), decamethylcyclopentasiloxane (D5), dodecamethylpentasiloxane (MD3M), and dodecamethylcyclohexasiloxane (D6).

19. The method of claim 16, wherein a temperature of a liquid or a vapor used to heat the organic fluid in the heat exchanger is about 80° C. to 400° C.

20. The method of claim 16, wherein a temperature of a liquid or a vapor used to heat the organic fluid in the heat exchanger is below about 300° C.

* * * * *